US005469626A

United States Patent [19]

Vogel et al.

[11] Patent Number: 5,469,626

[45] Date of Patent: Nov. 28, 1995

[54] SCISSORS

[75] Inventors: David S. Vogel; Donald E. Vogel, both of Columbus, Ohio

[73] Assignee: Vogel Brothers Corporation, Columbus, Ind.

[21] Appl. No.: 52,586

[22] Filed: Apr. 23, 1993

[51] Int. Cl.[6] ..... B26B 13/06

[52] U.S. Cl. ..... 30/266; 30/254

[58] Field of Search ..... 30/254, 266, 267, 30/244, 194

[56] References Cited

U.S. PATENT DOCUMENTS

| | | | |
|---|---|---|---|
| 3,376,641 | 4/1968 | Usborne | 30/266 |
| 4,133,107 | 1/1979 | Vogel | 30/266 |
| 4,250,620 | 2/1981 | Nishikawa | 30/254 |
| 4,420,884 | 12/1983 | Hembling | 30/266 |

FOREIGN PATENT DOCUMENTS

| | | | |
|---|---|---|---|
| 557186 | 5/1958 | Canada | 30/266 |
| 431240 | 7/1935 | United Kingdom | 30/266 |
| 625221 | 6/1949 | United Kingdom | 30/266 |

*Primary Examiner*—Hwei-Siu Payer

*Attorney, Agent, or Firm*—McAndrews, Held & Malloy, Ltd.

[57] ABSTRACT

An improved cutting tool, such as scissors, shears, and the like, having two cooperating members that are interconnected so as to be pivotally movable, with respect to each other and about a connection point, between an open position and a closed position. The members each have a handle at their one end, a shank portion disposed between the handle and the connection point, and a blade portion disposed between the connection point and their other end. Each of the shank portions have an inside face, an outside face, and a leading edge that faces the other leading edge when the members are in their open position. A bearing ramp is formed on the inside face of one of the shank portions and has a first end adjacent the leading edge of the one shank portion and a second end away from the leading edge. The ramp projects from and above the surface of the inside face a distance that gradually increases between the first end and the second end, and is adapted to contact the inside face of the other shank portion so that, as the cooperating members are moved from their open position to their closed position, the other shank portion gradually climbs up the ramp.

5 Claims, 1 Drawing Sheet

SCISSORS

BACKGROUND OF THE INVENTION

The present invention relates to improved scissors, shears and the like, and in particular, to improved high-quality scissors and shears, and an improved method of making them.

Scissors, shears and like tools have included two cooperating members that are interconnected, by a pivot pin, bolt and nut, rivet, screw or the like, at a connection point located between their ends, so that the members can be moved, with "scissors-like" action, between a closed position and an open position. Each of the members have a handle formed at their one end, a shank portion disposed between the handle and the connection point, i.e., the pivot pin, bolt and nut, rivet, screw, etc., and a blade portion disposed between the connection point in their other end. The blade portions and the shank portions each have an inside face and an outside face. The blade portions also include cutting edges which usually extend from adjacent to the connection point to their other ends. The members are generally arranged so that when they are in their closed position, the two inside faces of the blade portions and the two inside faces of the shank portions at least partially overlap and are adjacent to each other.

For may years, the manufacture of conventional, high-quality tools required a number of expensive hand grinding operations and the efforts of skilled experienced artisans to shape, sharpen and polish blades and make sure their cutting edges are in proper alignment.

One of the most critical and time consuming of these hand grinding operations was the grinding of the surface or the "ride" of the inside faces of the shank portions so that when these inside faces are moved into contact with each other, as when the members are moved from their open to their closed position, the blade portions will be biased together so as to provide a satisfactory cutting or shearing action. When the hand grinding operation has been properly done, there only will be a "point contact" or "point of contact" between the cutting edges of the members. The artisans doing this critical hand grinding operation always attempt to grind the inside faces of the shank portions so that this point contact between the cutting edges is initially located near the point of initial intersection between the cutting edges and then moves out, along the cutting edges, to their other distal ends as the members are moved to their closed position. Ideally, this critical hand grinding operation should also impart a desirable "feel" to the tool, i.e., require a constant force to move the members from their open position to their closed position.

If the grinding operation is not done properly, the point of contact between the cutting edges may not occur until the blade portions are moved to their closed position. Rather than cutting materials, the blades will just fold the material over, and the material will force the blades apart so that it just passes between the blades.

Alternatively, the shank portions may be ground too much, so that there is excessive contact between the cutting edges of the blades. This results in a tool having a heavy or hard "feel" that requires increased force to move the members from their open position to their closed position. In addition, the excessive contact causes the cutting edges to become dull relatively rapidly.

It has long been recognized by those skilled in this art that the hand grinding of the inside faces of the shank portions by skilled artisans was one of the most time consuming and thus expensive operations involved in the manufacture of scissors, shears and like tools.

One alternative to the hand grinding operation was proposed in Vogel U.S. Pat. No. 4,133,107. That patent discloses a cutting tool having a bearing dimple formed on the inside face of one of the shank portions. The bearing dimple projects above and from the surface of the inside face of the shank portion and contacts the inside face of the other shank portion as the cutting tool is moved from an open to a closed position. Contact with the bearing dimple biases the one ends of the members apart, about the connection point, so that there will be "point contact" between the cutting edges of the two members. A molded bearing projection similar to that disclosed in the Vogel patent is disclosed in Nishikawa U.S. Pat. No. 4,250,620. While the Vogel bearing dimple concept works very well for creating the bias of the cutting edges about the connection point, its uniform height can not create sufficient bias at the distal ends of the members to enable the cutting tool to have a light feel, or what is known in the art as a "Japanese feel."

Another alternative to the hand grinding operation was proposed in Hembling U.S. Pat. No. 4,420,884. That patent discloses a scissors having control cams stamped on each shank portion of the scissors. The cams are in sliding contact over one another and cause the planes of the blades to tilt relative to one another so that the cutting portions of the blades are in contact, and so that there is point contact along the cutting edges as the blades are closed. Although the Hembling concept of surface to surface camming action permits point contact of the cutting edges, it also results in a "sticky or gummy" feel that requires increased cutting force.

Cutting tools having a light or "Japanese feel" have been increasingly in demand, particularly by those who use a cutting tool extensively during the work day, since very little cutting force is needed to operate such tools. "Japanese feel" cutting tools are relatively expensive due to the tremendous amount of hand work that must be done to precisely grind the surface of the shank portions. More specifically, the shank portions of the "Japanese feel" tools must be ground so that there is sufficient bias at the distal ends of the members to obtain the desired light feel, yet not so much that the point of contact only occurs when the blade portions are moved to their closed position.

SUMMARY OF THE INVENTION

One of the principal objects of the present invention is to provide an improved, high quality cutting tool, such as scissors, shears or the like having a light, or "Japanese feel" which does not require any significant hand grinding of the inside faces of the shank portions of the members in order to achieve point contact between the cutting edges of the members. A related object of the invention is to provide an improved cutting tool that can be manufactured for a fraction of the cost of cutting tools manufactured utilizing conventional hand grinding operations.

More specifically, the improved tool of the present invention includes first and second cooperating members. Each of these members have a handle on their one ends and are interconnected, at a connection point located intermediate their ends, by a screw, pivot pin, rivet or the like, so that the members may pivotally move about the connection point between an open position wherein the two handles and the other ends of the members are spaced apart and a closed position wherein the two handles are adjacent to each other and the other ends of the members are adjacent to each other. Shank portions are disposed on each of the first and second members between their handles and the connection point, and each shank portion includes an outside face, an inside face, and a leading edge that faces the other leading edge of the other shank portion when the members are in their open position. Blade portions are disposed on each of the first and second members between the connection point and the other ends of the members and each includes an inside face, an outside face, and a cutting edge that extends from adjacent to the connection point to the other end of the member. The members are constructed and arranged so that as the members are moved from their open position to their closed position, the inside faces of the shank portions overlie or overlap each other and are adjacent to each other.

A novel bearing ramp is formed on the inside surface of one of the shank portions. This bearing ramp projects above and from the surface of the inside face of the one shank portion and is adapted to contact the inside face of the other shank portion as the cooperating members are moved from their open position to their closed position. The bearing ramp has a first end adjacent the leading edge of the shank portion and a second end away from the leading edge. The height of the ramp builds gradually from the first end of the ramp to the second so that, as the cooperating members are moved from their open position to their closed position, the inside face of the other shank portion contacts the ramp and gradually "climbs" up the ramp. The contact between the bearing ramp and the inside face of the other shank portion biases or "tilts" the one ends of the members apart, about the connection point, so that there will be "point contact" between the cutting edges of the cooperating members. The bearing ramp is disposed on the one shank portion in relation to the connection point so that the initial "point contact" or "point of contact" between the cutting edges is adjacent the connection point as the cutting edges first intersect during the movement of the cooperating members from their open position to their closed positions. This "point of contact" then moves out along the cutting edges to the other ends of the members as the cooperating members continue to be moved to their closed positions. Because the bearing ramp is disposed across the inside surface of the shank portion, the inside face of the other shank portion continues to climb the ramp as the cooperating members are closing, thus enabling the "point of contact" to move all the way out to the distal ends of the cooperating members.

As noted above, the utilization of a bearing ramp, instead of the hand grinding operations on the inside faces of the shank portions, significantly reduces the time and cost of manufacturing a scissors, shears or other like tools without any impairment of the quality of the finished tool. In addition, because the height of the bearing ramp builds gradually, the bearing ramp allows the contact point between the cutting edges to move all the way out to the distal ends of the cooperating members, thus representing an improvement over the bearing dimple disclosed in Vogel U.S. Pat. No. 4,133,107. Another important advantage of the bearing ramp is that, as the inside face of the other shank portion gradually climbs up the ramp, there is only a single point of contact between the inside face and the ramp. Unlike the sliding contact of the cams disclosed in Hembling U.S. Pat. No. 4,420,884, this single point of contact is always minute at any given point, resulting in less friction and imparting a very desirable light or "Japanese feel" to the tool. Moreover, the present invention is advantageous from a marketing standpoint since the invention enables all tools made utilizing such a bearing ramp to have the same desirable "feel"; i.e., the same force is required to move the tools from their open to their closed positions. In contrast, tools made by the conventional hand grinding operation each had an individual "feel" since even a skilled artisan has difficulty grinding two separate tools exactly the same way.

In summary then, tools embodying the novel bearing ramp can be manufactured at a significantly lower cost since there is a marked savings in the time and manual labor required for manufacturing the tools. In addition, relatively unskilled laborers can be used to perform many of the manufacturing operations which heretofore required skilled, experienced artisans. Furthermore, the improved tools of the present invention have a uniform "feel" which is a real advantage for mass-marketing the tools to consumers.

These and other objects and advantages of the present invention will become apparent from the following description of the preferred embodiment of the invention, described in connection with the accompanying drawings.

DESCRIPTION OF THE PREFERRED EMBODIMENT

Figure 1:
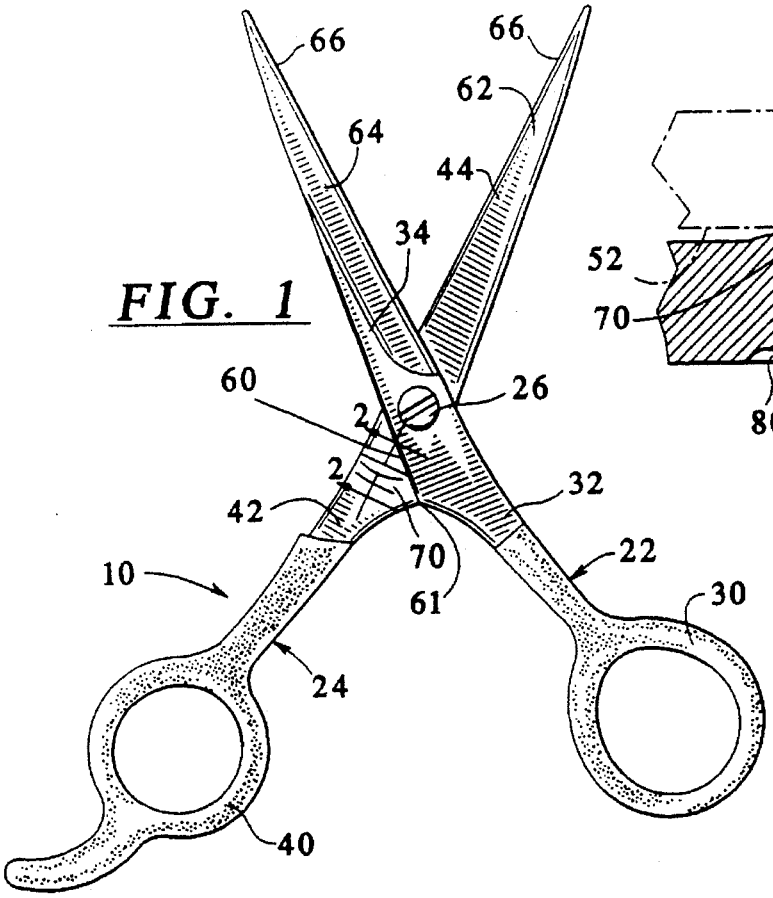
FIG. 1 is a top plan view of an improved scissors of the present invention showing the scissors members as they are initially moved from their open position to their closed position.

Referring now to the drawings, FIG. 1 illustrates an improved scissors 10 of the present invention. The scissors 10 comprises a first member 22 and a second member 24 which are interconnected, intermediate their ends, by a connector 26 which may, for instance, be a screw, a pin, a nut and bolt, a rivet, or the like. The first member 22 has a handle 30 formed on its one end, a shank portion 32 disposed between the handle 30 and the connector 26, and a blade portion 34 disposed between the connector 26 and its other end. Similarly, the second member 24 has a handle 40 formed on its one end, a shank portion 42 disposed between the handle 40 and the connector 26, and a blade portion 44 disposed between the connector 26 and the other end of the second member. The members 22 and 24 are arranged so that they may pivotally move, about the axis of the connector 26, between an open position, in which the handles 30 and 40 are spaced apart, and a closed position, in which the handles 30 and 40 are adjacent to and in contact with each other.

Figure 2:
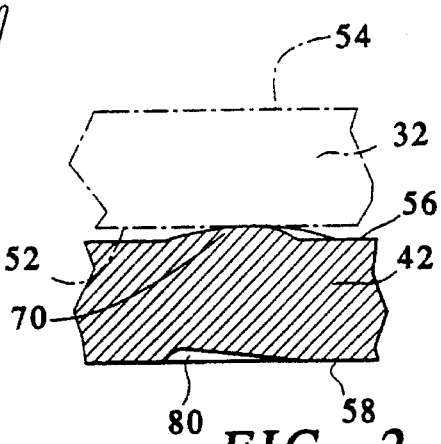
FIG. 2 is a partial cross-sectional view taken along the line 2—2 in FIG. 1.
Figure 3:
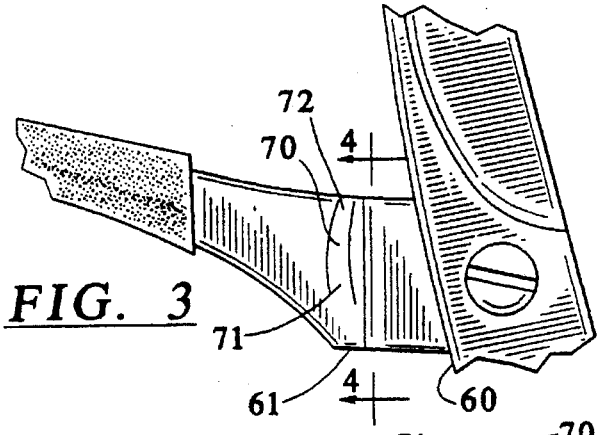
FIG. 3 is an enlarged partial top plan view of an improved scissors showing the bearing ramp in more detail.

Referring to FIGS. 1–3, the shank portion 32 has an inside face 52, an outside face 54, and a leading edge 60, and the shank portion 42, likewise, includes an inside face 56, an outside face 58 and a leading edge 61. The leading edges 60 and 61 face each other when the members are in their open position. The shank portions 32 and 42 are designed so that when the first and second members 22 and 24 are moved from their open position to their closed position, the inside faces 52 and 56 of the shank portions 32 and 42 overlap and are adjacent to each other. The inside faces 52 and 56 thus overlie each other and are generally parallel to each other, with the degree of overlap depending upon how far the first and second members have been moved toward their closed position.

Each of the blade portions 34 and 44 include an inside face 62, an outside face 64, and a cutting edge 66. The inside faces 62 overlap and are adjacent to each other when the first and second members 22 and 24 are in their closed position.

Figure 4:
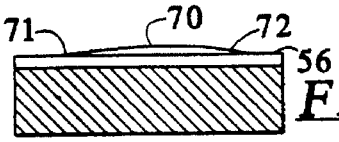
FIG. 4 is a partial cross-sectional view taken along the line 4—4 in FIG. 3.

As more clearly illustrated in FIGS. 2–4, a bearing ramp 70 is integrally formed on the inside face 56 of the shank portion 42. The bearing ramp 70 projects from and above the inside face of the shank portion with the height of the ramp, i.e., the distance it projects above the inside face 56, gradually increasing from a first end 71 of the ramp to its second end 72 in a direction toward the cutting edge 66 of the blade portion. The bearing ramp 70 is positioned on the inside face 56 so that the first end 71 is adjacent to the leading edge 61 of the shank portion 42 and the second end 72 is away from the leading edge. Although the ramp is illustrated as being positioned so that a longitudinal axis extending between the first and second ends is generally perpendicular to the leading edge 61 of the shank portion 42, the ramp could also be positioned on an angle, with the second end 72 either angled toward the handle 40 or toward the blade portion 44. The height of the ramp will vary depending upon the position selected for the ramp relative to the leading edge. The ramp is positioned so that it lies within the "sweep" of the shank portion 32, and the inside face 52 of the shank portion 32 contacts the ramp and gradually "climbs" up it when the first and second members 22 and 24 are moved from their open position to their closed position. The gradual "climbing" of the inside face 52 up the bearing ramp 70 insures that there is only a single contact point between the inside face 52 and the bearing ramp 70. This contact point is minute at any given point, resulting in less friction between the members 22 and 24 so that the members move easily from their open position to their closed position.

Figure 6:
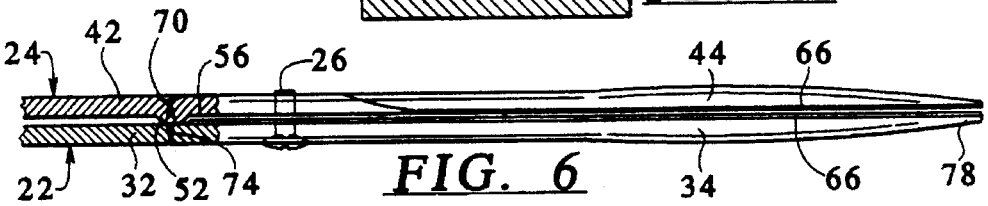
FIG. 6 is a partial side view of the improved scissors of FIG. 5, viewed from the right side with respect to FIG. 5.

As best shown in FIG. 6, when the bearing ramp 70 contacts the inside face 52 of the shank 32, the shank portions 32 and 42 are forced apart, about an axis which is coaxial with the longitudinal axis of the connector 26, i.e., generally perpendicular to the planes of the inside faces 52 and 56, as indicated by the arrows 74. This biasing or "tilting" of the shank portions 32 and 42 results in the blade portions 34 and 44 being forced together so that there is point contact between the cutting edges 66 of the first and second members 22 and 24. As indicated by arrows 78, this point contact between the cutting edges is moved out all the way to the distal ends of the members 22 and 24 when the members are moved to their closed position.

Figure 5:
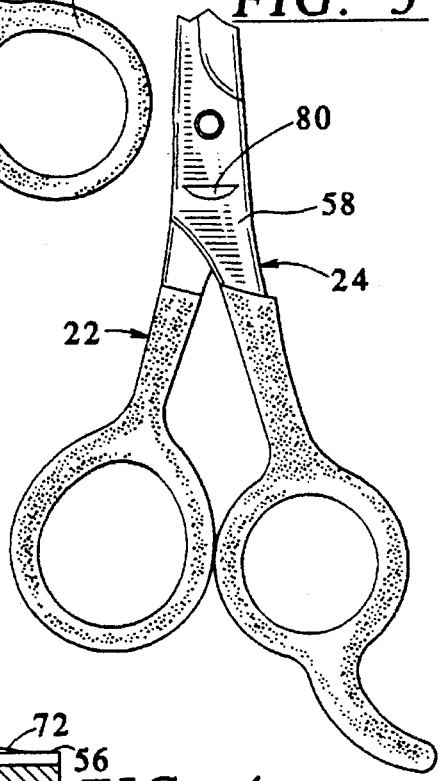
FIG. 5 is a bottom plan view of the improved scissors of FIG. 1 in their closed position.

The bearing ramp 70 is positioned on the shank portion 42 so that the point contact between the cutting edges 66 is initially adjacent to the point where the cutting edges initially intersect as the members 22 and 24 are moved from their open position to their closed position. As best understood from a reference to FIGS. 2 and 5, the bearing ramp 70 is formed onto the inside face 56 of the shank portion 42 by striking the outside face 58 of the shank portion with a conventional punching tool. The punching tool makes a depression 80 in the outside face 58 and forms the bearing ramp 70 on the inside face 56. By controlling or regulating the force applied to the punching tool, bearing ramps 70 of approximately the same size and height can be formed so that the cutting tools will all have the same "feel".

Scissors embodying the principles of the invention have been made and found to have a superior cutting action with a very desirable light or "Japanese feel." In one such five-inch scissors, the bearing ramp was positioned on the inside face of the shank so that the midpoint of the ramp was approximately 7/16 of an inch from the center of the connector hole. The ramp had a width of approximately 1/16–1/8 of an inch, and, at its highest point, projected above the inside face of the shank a distance of about 0.003 inches. This scissors can be manufactured at a fraction of the cost for manufacturing a conventional scissors having a "Japanese feel" and without the need to employ the many hours of hand work involved in making such conventional scissors.

The invention disclosed herein may be embodied in other specific forms without departing from the spirit or central characteristics thereof. The preferred embodiment described herein is therefore to be considered in all respects as illustrative and not restrictive, the scope of the invention being indicated by the appended claims, rather than by the foregoing description of the preferred embodiment, and all changes which come within the meaning and range of equivalency of the claims are intended to be embraced therein.

What is claimed is:

1. In a cutting tool comprising:

first and second cooperating metal members, with each of the first and second members having a first end, a second end and a longitudinal central axis extending between their first and second ends;

a first handle on the first end of the first member;

a second handle on the first end of the second member;

means for interconnecting the first and second members at a connection point disposed between their first ends and their second ends for permitting the first and second members to pivotally move, with respect to each other and about the connection point, between a closed position, where the second ends of the first and second members are adjacent to each other, and an open position, where the second ends of the first and second members are spaced from each other;

the first and second members each having a shank portion disposed adjacent to the connection point and between the connection point and their first ends, the shank portions each having an outside face, a leading edge that faces the leading edge of the other shank portion when the members are in their open position, and an inside face that has a planar, substantially flat surface, with the surfaces of the inside faces of the shank portions of the first and second members being substantially parallel to each other but being spaced from each other a predetermined distance and substantially overlying each other as the first and second members approach their closed positions and while the first and second members are in their closed positions;

the first and second members each including a blade portion disposed between their second ends and the connection point, with each of the blade portions having an inside face, an outside face and a cutting edge;

the improvement which comprises:

a bearing ramp disposed on the inside face of the shank portion of only the first member, the bearing ramp having a gradually inclining first end adjacent to the leading edge of the shank portion and a second end that extends away from the leading edge and toward the cutting edge of the first member, with the bearing ramp projecting above the inside face of the shank of the first member a height that gradually increases in a direction from the first end of the ramp to the second end, and with the bearing ramp having a minimum projecting height, between its ends, that is greater than said predetermined distance so that, as the first and second members approach their closed position, the inside face of the shank portion of the second member contacts the first end of the bearing ramp and gradually climbs upwardly along the bearing ramp towards its second end with only a single point of contact between this inside face and the bearing ramp thereby resulting in less friction therebetween and imparting a desirable, "Japanese feel" to the tool, and so that, as a result of the gradual climbing upwardly of the inside face of the shank portion of the second member along the bearing ramp, there is substantially point contact between the cutting edges of the first and second members as the first and second members move from their open position to their closed position.

2. The improved tool described in claim 1 wherein the first and second members are substantially identical except for the inclusion of the bearing ramp on the first member; and wherein the first and second members pivotally move about an axis which is generally coaxial with the axis of the interconnection means and which is generally perpendicular to the longitudinal axes of the first and second members.

3. The improved tool described in claim 2 wherein the first and second members are made from stainless steel.

4. The improved tool described in claim 1 wherein the bearing ramp is a formed unitary portion of the first member.

5. The improved tool described in claim 1 wherein the bearing ramp is positioned on the inside face of the shank portion of the first member so that a longitudinal axis extending between the first and second ends of the ramp is substantially perpendicular to the leading edge of the shank portion of the first member.

* * * * *